US005088252A

United States Patent [19]

Antekeier

[11] Patent Number: 5,088,252

[45] Date of Patent: Feb. 18, 1992

[54] BASEBOARD CHANNEL MEMBER FOR PRE-CUT CARPET STRIPS

[76] Inventor: Mark D. Antekeier, 0-290 Leonard NW., Grand Rapids, Mich. 49504

[21] Appl. No.: 598,271

[22] Filed: Oct. 16, 1990

[51] Int. Cl.[5] ..... E04F 19/04

[52] U.S. Cl. ..... 52/288; 52/242; 52/273; 52/716

[58] Field of Search ..... 52/287, 288, 242, 716, 52/717, 273; 160/90, 38, 371

[56] References Cited

U.S. PATENT DOCUMENTS

| | | | |
|---|---|---|---|
| 1,424,658 | 8/1922 | Lidstone | 52/717 |
| 2,049,501 | 8/1936 | Herron | 52/717 |
| 3,100,522 | 8/1963 | McIntyre | 160/90 |

FOREIGN PATENT DOCUMENTS

| | | | |
|---|---|---|---|
| 1371128 | 7/1964 | France | 52/287 |
| 351369 | 6/1931 | United Kingdom | 52/312 |
| 2160912 | 1/1986 | United Kingdom | 52/287 |

*Primary Examiner*—James L. Ridgill, Jr.
*Attorney, Agent, or Firm*—Sughrue, Mion, Zinn, Macpeak & Seas

[57] ABSTRACT

An elongated, extruded, resilient plastic channel member has a flat rear wall for mounting to a vertical building wall and receives an elongated, precut carpet strip. The flat rear wall terminates at upper and lower longitudinal edges respectively in an integral, generally L-shaped lower wall and an integral, reversely directed, arcuate upper wall. Both project outwardly and away from the rear wall and define therebetween upper and lower slots receiving the upper and lower longitudinal edges of a decorative precut carpet strip whose width is sized to the slots and slidably inserted therein. The channel member rear wall is thickened adjacent the connection between the arcuate upper wall and the rear wall to resist flexing of the arcuate upper wall and to prevent release of the grip between the arcuate upper wall, at its free edge, and the pile of the carpet strip. Both the arcuate upper wall and the generally L-shaped lower wall terminate at free edges in right angle, inwardly directed lips which penetrate the carpet pile for maintaining the precut carpet strip in the inserted position and prevent vertical movement of the upper and lower edges of the carpet strip into and out of the respective upper and lower slots of the channel member. The channel member may be nailed, screwed or adhesively fixed at the rear surface of the rear wall to a vertical building wall, particularly functioning as a baseboard assembly with the precut carpet strip matching the floor carpet of the building structure.

6 Claims, 1 Drawing Sheet

FIG. 1
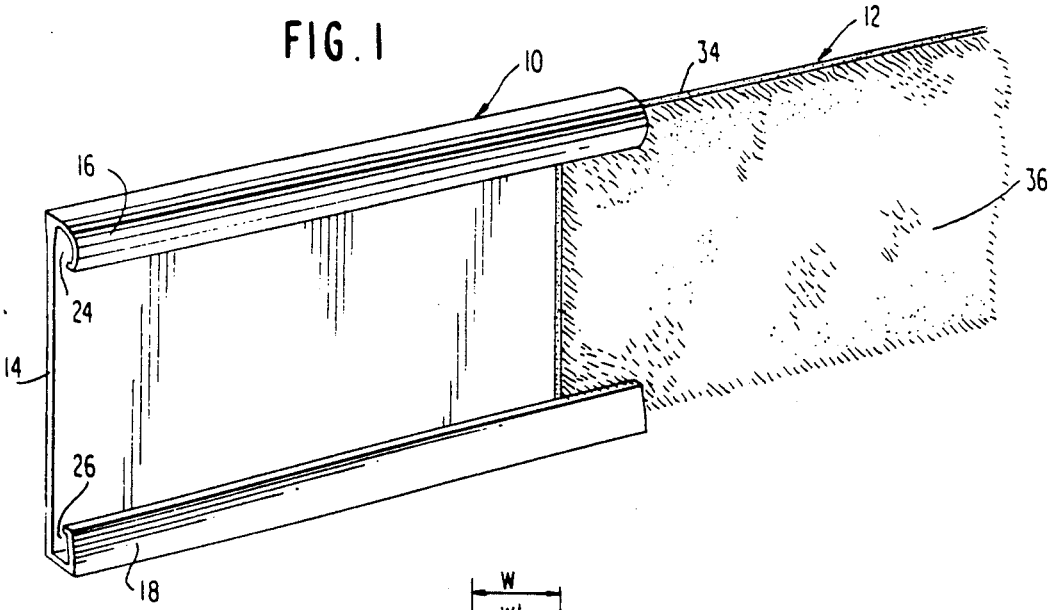
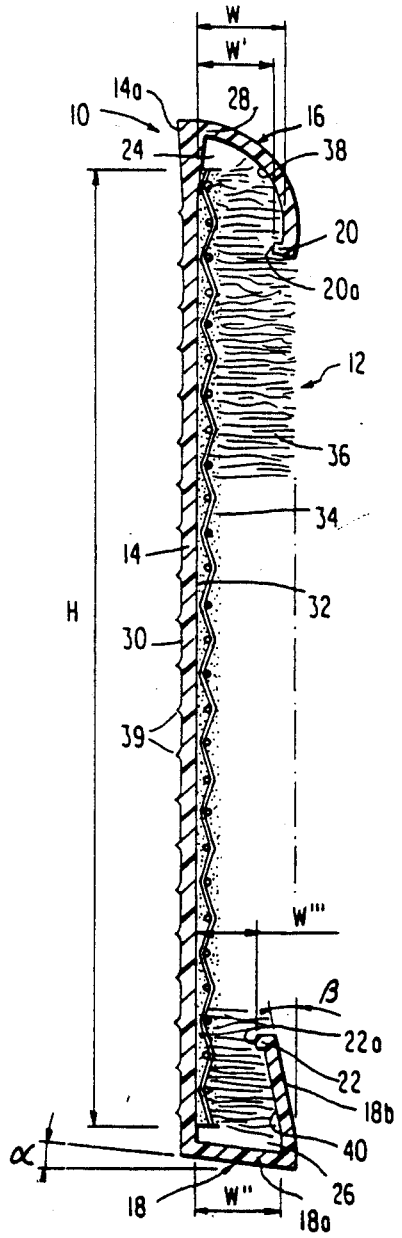
FIG. 2

BASEBOARD CHANNEL MEMBER FOR PRE-CUT CARPET STRIPS

FIELD OF THE INVENTION

This invention relates to baseboards as trim pieces for interior walls of residential homes, office buildings and the like, and more particularly, to an extruded baseboard channel member slidably receiving and bearing a precut decorative strip such as wall-to-wall carpet material, preferably matching the wall-to-wall carpeting on the floor against which the lower edge of the baseboard channel member abuts.

Conventionally, in decorating office space and living areas within the home, wall-to-wall carpeting is laid over the floor surface and flush with the vertical walls of the rooms defining the living areas of the home, or corridor space and office space of commercial office buildings, retail store areas, etc. To trim off the rooms about the bottoms of the vertical side walls and the various internal walls of the building, baseboards have been adhesively attached, nailed or otherwise affixed along the bottom edges of both partition walls and outer walls of the building with the baseboards in contact with the wall-to-wall carpeting and closing off the area of abutment between the lateral edge of the carpeting and the vertical partition walls and outer walls of the building. Such baseboards may indeed be pieces of lumber several inches in height and less than an inch in thickness. More often, such baseboards are formed as resilient plastic extrusions which may be of regular rectangular cross section and formed of an extruded material having a color compatible to the interior wall covering as well as the wall-to-wall carpeting on the floor of the building. Such baseboards, whether of wood or plastic are often marred by the appliances employed in cleaning of the carpeting or in the corridors, or by human or other traffic.

It is therefore a primary object of the present invention to provide an extruded resilient channel member purposely designed to hold an elongated decorative strip of carpeting or other visually attractive material as a wall baseboard or for other decorative purposes, which may be extruded of plastic or metal, or alternatively, roll formed, in which the decorative strip may be readily replaced as needed, or desired, and which provides a baseboard or like decorative channel assembly which is appealing to the eye, which effectively uses existing carpet scraps which provides ease in cleaning, which protects the base of the vertical partition or building wall to which it is applied, and which is capable of use in a wide range of colors to match, compliment or contrast the insert, and/or floor coverings and wall dressings.

SUMMARY OF THE INVENTION

The invention is directed to a resilient, extruded baseboard channel member for precut carpet strips, which member may be glued or nailed to wall board, framing boards, etc., and which may be formed in precut lengths, readily butt mounted and which permits precision mitered inside and outside corners to be effected, which slidably receives precut strips of carpeting, matching or contrasting to the floor carpeting and in forming an attractive trim piece which is constituted by a unitary extruded channel form member of resilient material having a vertical, flat rear wall, and terminating integrally along upper and lower edges in a generally L-shaped bottom wall and an integral, reversely directed arcuate upper wall projecting outwardly and away from the rear wall with said upper wall and bottom wall defining top and bottom slots receiving the upper and lower edges, respectively, and of an elongated decorative strip slidably insertable within the resilient channel member. Preferably, the rear wall of the unitary extruded resilient channel member is thickened adjacent the connection between the arcuate upper wall and the rear wall to resist flexing of the arcuate upper wall along the junction line with the rear wall. Further, preferably, the bottom L-shaped lower wall has a forwardly and downwardly oblique bottom wall portion and a lower front wall portion of arcuate configuration extending upwardly and rearwardly of the bottom wall portions along an edge thereof such that the upper and lower slots narrow in the direction of the free edge of the upper and lower walls to facilitate gripping of the slidably insertable decorative strip sized to the channel member slots. The free edges of the arcuate upper wall and the L-shaped lower wall terminate in lips projecting at right angles laterally into the slot and towards the rear wall of the extruded resilient channel member.

BRIEF DESCRIPTION OF THE DRAWINGS

FIG. 1 is an exploded perspective view of the extruded resilient elongated baseboard channel member forming a preferred embodiment of the invention and a carpet strip sized to and slidably receivable within the top and bottom slots of the channel member and resiliently gripped by the arcuate upper wall and L-shaped lower wall of the channel member.

FIG. 2 is a vertical sectional view of the baseboard channel member of FIG. 1 with the precut carpet strip inserted therein and forming a decorative trim piece.

DESCRIPTION OF THE PREFERRED EMBODIMENT

Referring to the drawings, while the unitary channel member is preferably formed of extruded, resilient plastic and is purposely designed to hold a strip of carpeting, it is apparent that the extruded, resilient channel member of this invention has broader application and may function other than as a baseboard and carry other than a precut carpet strip.

In FIG. 1, the baseboard channel member forming a preferred embodiment of the present invention is illustrated generally at 10 and slidably receives a correspondingly sized carpet strip indicated generally at 12 having a longitudinal dimension or length sized to that of the channel member 10, and having a transverse width and overall thickness matching the channel dimensions of extruded member 10. The baseboard channel member 10 is preferably of extruded plastic material such as PVC and the extrusion is comprised of a vertical rear wall 14, an integral, reversely directed or bent, arcuate, outwardly projecting upper wall 16 and an integral, outwardly projecting L-shaped lower wall 18 forming oppositely facing top and bottom grooves or slots 24, 26, respectively.

In the illustrated embodiment, preferably over the major portion of the length, the upper wall 16 and the lower wall 18 are of uniform thickness; however, the rear wall 14 terminates at its upper end, at the junction with integrally formed upper wall 16, in a tapered, increased thickness rear wall portion 14*a*. The purposes of the thickened portion 14a is to limit the flexing of the arcuate upper wall 16 about the joint 28 connecting the upper wall 16 to the thickened portion 14a of the rear wall 14. The arcuate upper wall 16 is of uniform thickness with that arc extending approximately 90° and terminating at its free end in a horizontal, right angle projection or lip 20 directed towards the surface of the rear wall 14 and defining with that rear wall the upper slot or groove 24 of the channel member 10. As a result of the arcuate configuration of the upper wall 16, and due to the projection of the integral lip 20 at the free end of the upper wall 16, face 20a of that lip is spaced a distance from the front surface 32 of rear wall 14 by a distance W', which is less than the distance W between that same rear wall rear surface 32 and the inside surface 38 of the upper wall 16 adjacent lip 20. This permits, when the carpet strip 12 is inserted longitudinally within the upper and lower grooves or slots 24, 26, the lip 20 to dig into the carpet pile 36 formed by the carpet threads and acting to stabilize the carpet strip 12 vertically captured within the channel member upper slot 24.

The same is true for the lower wall 18 of the channel member 10. The lower wall 18, integral with rear wall 14, has two portions, a near horizontal portion 18a of this L-shaped wall, which preferably extends obliquely downward and outwardly away from the rear wall 14 at an angle $\alpha$ to the horizontal of from about 5° to 20°, and a shallow arch nearly right angle front wall portion 18b which is at an angle $\beta$ on the order of 5° to 15° to the vertical. The free end of the front wall portion 18b terminates in a near right angle projecting lip 22 which is directed towards the front surface 32 of the rear wall 14 and thus in the direction of the bottom groove or slot 26. Lip 22 also buries into the pile 36 of the carpet strip 12 to resist upward or downward movement of the carpet strip 12 once it is slid sideways into slots or grooves 24, 26 of the baseboard channel member 10. In this case, the lateral width of slot 26 as defined by the distance from the front surface 32 of rear wall 14 and the rear surface of the front wall portion 18b is of a distance W'' which is slightly in excess of the width W''' between face 22a of the inwardly projecting lip 22 and that same rear wall, front surface 32.

As illustrated, it is not necessary that the vertical height H of the carpet strip 12 equal the distance from the inner surface of the bottom wall portion 18a of the lower wall of channel member 10 to the inner surface of the arcuate upper wall 16, at the juncture 28 between that upper wall and rear wall 14, since the carpet strip is captured and stabilized by lips 20 and 22 projecting into the fibers of the carpet, i.e., the front surface of pile 36 of that strip. The carpet 12 is formed essentially of a perforated carpet base to which warp and weft carpet threads are woven to form pile 36.

The baseboard channel member 10 can be easily nailed or screwed to framing members or glued to a finished wall surface. Such gluing can be facilitated by the creation of nodes or irregular surface projections 39 on rear surface 30 of rear wall 14. Such nodes 38 may be linear across the rear surface 30 the rear wall 14 at regular or irregular spacing. In the illustrated embodiment, the channel member accommodates most standard carpet thicknesses and has a ½ inch overall depth so as to butt up cleanly to standard wood and metal door jambs and casings.

While the channel member 10 is described in the illustrated embodiment as being formed of extruded, resilient plastic such as PVC. a metal or metal alloy such as aluminum may be employed, and the manufacturing process is not limited to extrusion since the product could be compression molded, roll formed, etc. Further, while the channel member 10 via slots or grooves 24, 26 is illustrated as holding a strip of carpet, any other visually attractive material strip such as leather, fabric, wood, metal or formica may be employed, particularly wall base or baseboard applications.

While the above invention has been described in detail with respect to a preferred embodiment, it should be understood that many changes may be made therein without departing from the spirit of the invention as set forth in the accompanying claims.

What is claimed is:

1. An elongated unitary resilient baseboard channel member comprising a flat rear wall having a generally L-shaped bottom wall projecting outwardly thereof from one longitudinal edge, and an integral, reversely directed arcuate upper wall projecting to the same side as the lower wall and defining therebetween and with said rear wall, upper and lower, oppositely facing slots for receiving upper and lower edges of an elongated decorative precut carpet strip including a base and a woven pile on one surface thereof over the surface area of the base, having a width on the order of the distance between the extremities of said upper and lower slots and being of a thickness on the order of the maximum distance between the outwardly projecting upper and lower walls and said rear wall of said channel member at said upper and lower slots and having upper and lower edges slidably insertably mounted within said slots, and wherein said reversely directed arcuate upper wall terminates in a free edge having a generally right angle lip projecting laterally outwardly thereof in the direction of the channel member rear wall and engaging said pile surface to restrict movement of the decorative strip into and out of the slot formed by the upper wall and the rear wall of the channel member, and wherein a front wall portion of said L-shaped lower wall terminates in a generally right angle, laterally inwardly directed lip in the direction of the rear wall and engages the front surface of the carpet strip pile and limits movement of the decorative strip into and out of the slot defined by the lower wall and the rear wall of the channel member.

2. The elongated resilient channel member as claimed in claim 1 of extruded plastic.

3. The unitary elongated resilient channel member as claimed in claim 1, wherein said rear wall is thickened in the vicinity of the upper longitudinal edge thereof adjacent the connection between the rear wall and the arcuate upper wall to resist flexing of the arcuate upper wall and release of the decorative strip slidably insertable into the upper and lower slots of the channel member.

4. The elongated resilient channel member as claimed in claim 3, wherein said L-shaped lower wall has an outwardly and downwardly oblique bottom wall portion and an integral, substantially right angle front wall portion, wherein said bottom wall portion is at an oblique angle $\alpha$ to a plane perpendicular to the rear wall of approximately 5° to 15°, and wherein said front wall portion extends obliquely to a plane parallel to the rear wall at an angle $\beta$ of approximately 5° to 15° in a direction towards the rear wall.

5. In combination, an elongated, extruded resilient baseboard channel member and a precut carpet strip, said channel member comprising a flat rear wall, terminating along upper and lower edges, respectively, in an integral, reversely directed, arcuate, outwardly projecting upper wall, and an integral generally L-shaped outwardly projecting lower wall defining, with said rear wall, upper and lower slots, said precut carpet strip including a base and woven pile on one surface thereof over the surface area of the base, having a width on the order of the distance between the extremities of said upper and lower slots and being of a thickness on the order of the maximum distance between the outwardly projecting upper and lower walls and said rear wall of said channel member at said upper and lower slots and having upper and lower edges slidably insertably mounted within said slots with the base of said carpet strip contacting said channel member rear wall and having free ends of said upper and lower walls engaging the surface of the carpet strip pile and resisting relative movement between said carpet strip and said channel member, and wherein said arcuate upper wall and said L-shaped lower wall each have free ends terminating in generally right angle lips projecting inwardly towards the rear wall of the channel member and engaging the pile of the carpet strip with the thickness of the carpet being in excess of the distance between the lips on said arcuate upper wall and said lower generally L-shaped wall, such that the lips penetrate into the pile of the carpet to hole the carpet in position within the channel member and resist movement of the carpet into and out of the upper and lower slots thereof.

6. The structural combination as claimed in claim 5, wherein said elongated, resilient channel member is a unitary extruded plastic member.

* * * * *